US011608657B2

(12) United States Patent
Gilbert

(10) Patent No.: US 11,608,657 B2
(45) Date of Patent: Mar. 21, 2023

(54) DOOR LOCK ILLUMINATION DEVICE

(71) Applicant: Donna Gilbert, Tucson, AZ (US)

(72) Inventor: Donna Gilbert, Tucson, AZ (US)

( * ) Notice: Subject to any disclaimer, the term of this patent is extended or adjusted under 35 U.S.C. 154(b) by 0 days.

(21) Appl. No.: 17/408,436

(22) Filed: Aug. 22, 2021

(65) Prior Publication Data

US 2023/0054987 A1 Feb. 23, 2023

(51) Int. Cl.
*E05B 17/10* (2006.01)

(52) U.S. Cl.
CPC ..... *E05B 17/10* (2013.01)

(58) Field of Classification Search
CPC ..... E05B 17/10
See application file for complete search history.

(56) References Cited

U.S. PATENT DOCUMENTS 5,094,093 A * 3/1992 Ben-Asher ..... E05B 47/0661 70/215
5,179,325 A * 1/1993 Aragon, Jr. ..... E05B 17/10 362/100
5,398,175 A * 3/1995 Pea ..... E05B 17/10 362/100
7,108,387 B1 * 9/2006 Lucas ..... E05B 1/0007 362/802
7,374,084 B2 * 5/2008 Mitchell ..... G07C 9/00658 235/382
7,866,195 B2 * 1/2011 Levine ..... E05B 41/00 116/80
9,758,990 B2 * 9/2017 Beck ..... E05B 17/22
2018/0058098 A1 * 3/2018 Marks ..... E05B 17/10
2019/0152440 A1 * 5/2019 Farges ..... B60R 25/246
2020/0362589 A1 * 11/2020 Salter ..... E05B 17/10

* cited by examiner

*Primary Examiner* — Alexander K Garlen

(74) *Attorney, Agent, or Firm* — The Iwashko Law Firm, PLLC; Lev Ivan Gabriel Iwashko

(57) ABSTRACT

A door lock illumination device connected to a door, the door lock illumination device including a main body, a key hole disposed on at least a portion of the main body to receive a key therein, and an illumination unit disposed within at least a portion of the main body to illuminate in response to the key hole receiving the key.

4 Claims, 2 Drawing Sheets

DOOR LOCK ILLUMINATION DEVICE

BACKGROUND

1. Field

The present general inventive concept relates generally to door locks, and particularly, to a door lock illumination device.

2. Description of the Related Art

Many people feel uncomfortable returning home with their lights off. The lack of any light can make it difficult to unlock and/or open a door to the home. Also, the lack of light can exacerbate the difficulty in finding a key to unlock a door knob and/or a door lock. The time spent attempting to open a door could be dangerous to a homeowner if they are unable to see a possible attacker and/or a defect around the home, such as a broken step.

Therefore, there is a need for a door lock illumination device to illuminate the door knob and/or the door lock.

SUMMARY

The present general inventive concept provides a door lock illumination device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a door lock illumination device connected to a door, the door lock illumination device including a main body, a key hole disposed on at least a portion of the main body to receive a key therein, and an illumination unit disposed within at least a portion of the main body to illuminate in response to the key hole receiving the key.

The illumination unit may illuminate an outer surface and an interior of the key hole in response to the key hole receiving the key.

The illumination unit may illuminate in response to the key hole receiving contact by the key on an outer surface of the key hole.

The door lock illumination device may further include a sensor disposed within at least a portion of the main body to determine whether the key is a correct key for the key hole, such that the illumination unit flashes in response to the sensor determining the key is an incorrect key for the key hole, and illuminates a static light in response to the sensor determining they key is the correct key for the key hole.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Door Lock Illumination Device 100
Main Body 110
Key Hole 120
Illumination Unit 130
Sensor 140
Door Lock Illumination Device 200
Main Body 210
Key Hole 220
Illumination Unit 230
Sensor 240

Figure 1:
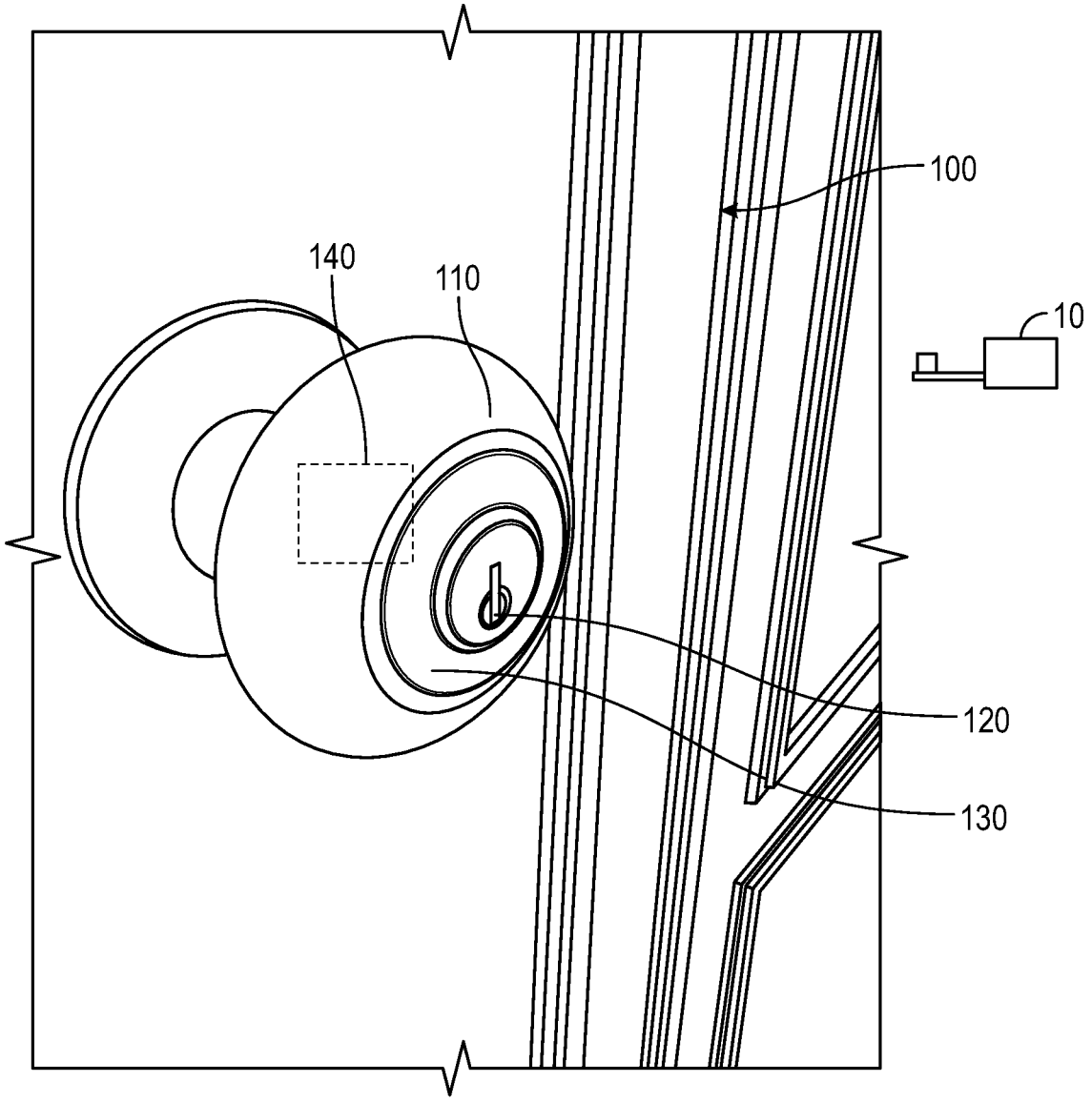
FIG. 1 illustrates a side perspective view of a door lock illumination device, according to an exemplary embodiment of the present general inventive concept.

FIG. 1 illustrates a side perspective view of a door lock illumination device 100, according to an exemplary embodiment of the present general inventive concept.

The door lock illumination device 100 may be constructed from at least one of metal, plastic, wood, glass, and rubber, etc., but is not limited thereto.

The door lock illumination device 100 may include a main body 110, a key hole 120, an illumination unit 130, and a sensor 140, but is not limited thereto.

The main body 110 may be a door knob connected to a door. Referring to FIG. 1, the main body 110 is illustrated to be a cylindrical knob. However, the main body 110 may be a lever handle, a handleset, a passage knob, and a dummy knob, but is not limited thereto.

The key hole 120 may be disposed on and/or within at least a portion of the main body 110. The key hole 120 may receive a key 10 therein. Moreover, the key hole 120 may rotate in a first direction (i.e., clockwise) or a second direction (i.e., counterclockwise) to lock a door while the key 10 is disposed therein. Conversely, the key hole 120 may rotate in the second direction or the first direction to unlock the door.

The illumination unit 130 may include a light (e.g., a light emitting diode (LED)), a battery, and a solar cell, but is not limited thereto.

The illumination unit 130 may be disposed within at least a portion of the main body 110 and connected to the key hole 120. The illumination unit 130 may illuminate an outer surface and/or an interior of the key hole 120 and/or at least a portion of the main body 110 in response to the key hole 120 receiving contact by the key 10 on an outer surface of the key hole 120 and/or directly within the key hole 120. As such, the illumination unit 130 may facilitate viewing in a dark and/or a low light environment by illuminating a surrounding area of the main body 110 and/or the key hole 120.

The sensor 140 may be disposed within at least a portion of the main body 110 and connected to the illumination unit 130. The sensor 140 may detect contact of the key hole 120 by the key 10, such that the illumination unit 130 may illuminate in response to the sensor 140 detecting contact of the key hole 120 by the key 10. Moreover, the sensor 140 may determine whether the key 10 is a correct key for the key hole 120. More specifically, the illumination unit 130 may flash and/or blink in response to the sensor 140 determining the key 10 is an incorrect key for the key hole 120. However, the illumination unit 130 may illuminate a static light in response to the sensor 140 determining they key 10 is the correct key for the key hole 120. As such, the sensor 140 may assist a user in finding the correct key.

Therefore, the door lock illumination device 100 may the door knob and/or the door lock to assist the user in opening the door. Also, the door lock illumination device 100 may deter an attacker while the illumination unit 130 is illuminated.

Figure 2:
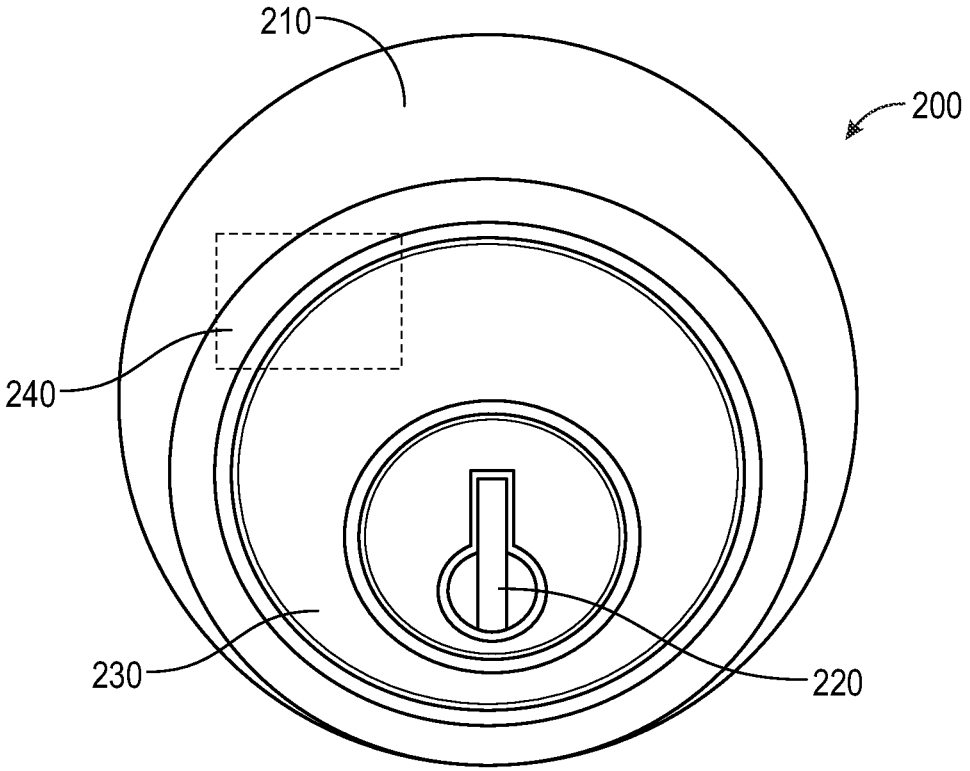
FIG. 2 illustrates a front perspective view of a door lock illumination device, according to another exemplary embodiment of the present general inventive concept.

FIG. 2 illustrates a front perspective view of a door lock illumination device 200, according to another exemplary embodiment of the present general inventive concept.

The door lock illumination device 200 may be constructed from at least one of metal, plastic, wood, glass, and rubber, etc., but is not limited thereto.

The door lock illumination device 200 may include a main body 210, a key hole 220, an illumination unit 230, and a sensor 240, but is not limited thereto.

The main body 210 may be a door lock connected to a door. Referring to FIG. 2, the main body 210 is illustrated to be a yale lock. However, the main body 210 may be a sash lock, a deadlock, a euro lock, a scandinavian lock, and a multipoint door lock, but is not limited thereto.

The key hole 220 may be disposed on and/or within at least a portion of the main body 210. The key hole 220 may receive a key 10 therein. Moreover, the key hole 220 may rotate in a first direction (i.e., clockwise) or a second direction (i.e., counterclockwise) to lock a door while the key 10 is disposed therein. Conversely, the key hole 220 may rotate in the second direction or the first direction to unlock the door.

The illumination unit 230 may include a light (e.g., a light emitting diode (LED)), a battery, and a solar cell, but is not limited thereto.

The illumination unit 230 may be disposed within at least a portion of the main body 210 and connected to the key hole 220. The illumination unit 230 may illuminate an outer surface and/or an interior of the key hole 220 and/or at least a portion of the main body 210 in response to the key hole 220 receiving contact by the key 10 on an outer surface of the key hole 220 and/or directly within the key hole 220. As such, the illumination unit 230 may facilitate viewing in a dark and/or a low light environment by illuminating a surrounding area of the main body 210 and/or the key hole 220.

The sensor 240 may be disposed within at least a portion of the main body 210 and connected to the illumination unit 230. The sensor 240 may detect contact of the key hole 220 by the key 10, such that the illumination unit 230 may illuminate in response to the sensor 240 detecting contact of the key hole 220 by the key 10. Also, the sensor 240 may determine whether the key 10 is a correct key for the key hole 220. More specifically, the illumination unit 230 may flash and/or blink in response to the sensor 240 determining the key 10 is an incorrect key for the key hole 220. However, the illumination unit 230 may illuminate a static light in response to the sensor 240 determining they key 10 is the correct key for the key hole 220. As such, the sensor 240 may assist a user in finding the correct key.

Therefore, the door lock illumination device 200 may the door knob and/or the door lock to assist the user in opening the door. Also, the door lock illumination device 200 may deter an attacker while the illumination unit 230 is illuminated.

The present general inventive concept may include a door lock illumination device 100 connected to a door, the door lock illumination device 100 including a main body 110, a key hole 120 disposed on at least a portion of the main body 110 to receive a key 10 therein, and an illumination unit 130 disposed within at least a portion of the main body 110 to illuminate in response to the key hole 120 receiving the key 10.

The illumination unit 130 may illuminate an outer surface and an interior of the key hole 120 in response to the key hole 120 receiving the key 10.

The illumination unit 130 may illuminate in response to the key hole 120 receiving contact by the key 10 on an outer surface of the key hole 120.

The door lock illumination device 100 may further include a sensor 140 disposed within at least a portion of the main body 110 to determine whether the key 10 is a correct key for the key hole 120, such that the illumination unit 130 flashes in response to the sensor 140 determining the key 10 is an incorrect key for the key hole 120, and illuminates a static light in response to the sensor 140 determining they key 10 is the correct key for the key hole 120.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A door lock illumination device connected to a door, the door lock illumination device comprising:

a main body;

a key hole disposed on at least a portion of the main body to receive a key therein; and an illumination unit disposed within at least a portion of the main body to illuminate in response to the key hole receiving the key directly within an interior of the key hole.

2. The door lock illumination device of claim 1, wherein the illumination unit illuminates an outer surface and an interior of the key hole in response to the key hole receiving the key.

3. The door lock illumination device of claim 1, further comprising:

a sensor disposed within at least a portion of the main body to determine whether the key is a correct key for the key hole, such that the illumination unit flashes in response to the sensor determining the key is an incorrect key for the key hole, and illuminates a static light in response to the sensor determining the key is the correct key for the key hole.

4. A door lock illumination device connected to a door, the door lock illumination device comprising:

a main body;

a key hole disposed on at least a portion of the main body to receive a key therein; and an illumination unit disposed within at least a portion of the main body to illuminate from an interior of the key hole to an external environment outside of the key hole in response to the key hole receiving the key directly within the interior of the key hole.

* * * * *